United States Patent [19]

Yakuwa et al.

[11] Patent Number: 4,644,917

[45] Date of Patent: Feb. 24, 1987

[54] METHOD AND APPARATUS FOR CONTROLLING AN INTERNAL COMBUSTION ENGINE

[75] Inventors: Masahiko Yakuwa; Hideto Iijima, both of Wako, Japan

[73] Assignee: Honda Giken Kogyo Kabushiki Kaisha, Tokyo, Japan

[21] Appl. No.: 826,536

[22] Filed: Feb. 6, 1986

[30] Foreign Application Priority Data

Feb. 6, 1985 [JP] Japan ..... 60-19856

[51] Int. Cl.[4] ..... F02P 5/00

[52] U.S. Cl. ..... 123/414; 123/416; 123/417

[58] Field of Search ..... 123/414, 416, 418, 424, 123/406

[56] References Cited

U.S. PATENT DOCUMENTS

| | | | |
|---|---|---|---|
| 3,738,339 | 6/1973 | Huntzinger et al. | 123/416 |
| 3,923,021 | 12/1975 | Stark | 123/416 |
| 4,061,938 | 12/1977 | Hashimoto et al. | 123/414 |
| 4,181,884 | 1/1980 | Shirasaki et al. | 123/416 |
| 4,250,846 | 2/1981 | Manard | 123/414 |
| 4,324,217 | 4/1982 | Ina et al. | 123/416 |
| 4,355,613 | 10/1982 | Rode et al. | 123/417 |
| 4,378,004 | 3/1983 | Petrie | 123/416 |
| 4,380,983 | 4/1983 | Kobashi et al. | 123/416 |
| 4,485,784 | 12/1984 | Fuji et al. | 123/416 |

*Primary Examiner*—Raymond A. Nelli

*Attorney, Agent, or Firm*—Armstrong, Nikaido, Marmelstein & Kubovcik

[57] ABSTRACT

A method and apparatus for controlling an internal combustion engine is provided, the apparatus includes using a first crank angle position detector for generating a reference pulse at a predetermined crank angle period in synchronization with the rotation of a crank shaft of the internal combustion engine, and a second crank angle position detector for generating a crank angle pulse at a fixed crank angle period shorter than the period of the reference pulse. The operation of the internal combustion engine is controlled by using the reference pulse and the crank angle pulse, wherein the reference pulse is generated between the crank angle pulses. Further, an auxiliary pulse is generated from the second crank angle position detector upon generation of the reference pulse. The internal combustion engine is controlled by using the auxiliary pulse when the first crank angle position detector is not operating properly.

9 Claims, 10 Drawing Figures

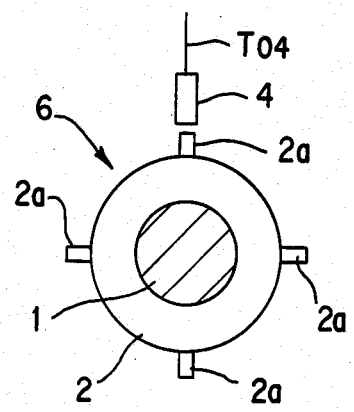
FIG. 1A
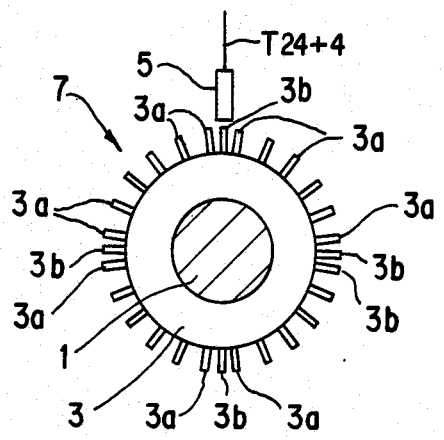
FIG. 1B
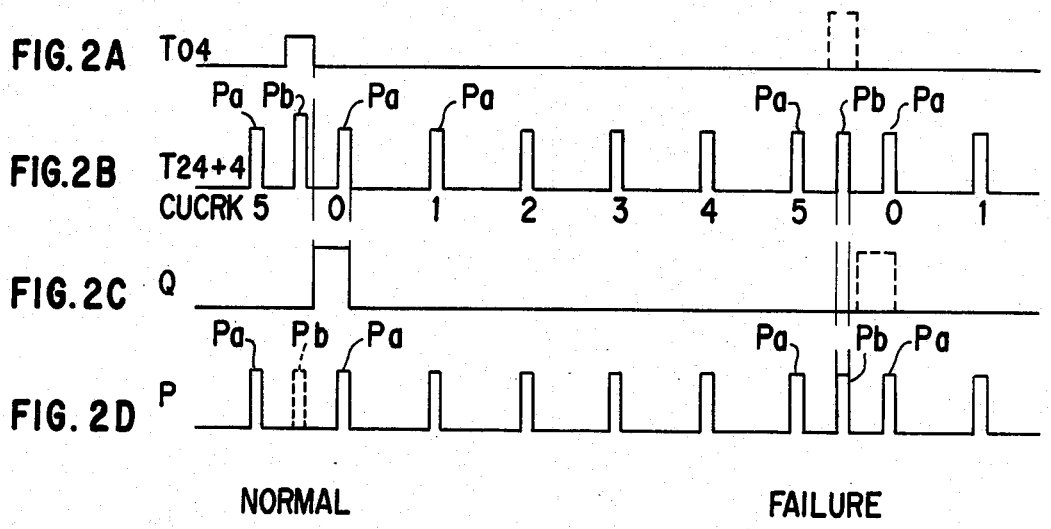

METHOD AND APPARATUS FOR CONTROLLING AN INTERNAL COMBUSTION ENGINE

BACKGROUND OF THE INVENTION

1. Field of the Invention

This invention relates to a method and apparatus for controlling an internal combustion engine.

2. Description of the Prior Art

In a conventional electronic method of controlling an internal combustion engine, a method is employed using a reference pulse sensor for generating a reference pulse at predetermined crank angle periods in synchronization with the rotation of a crank shaft, and a crank angle sensor for generating a crank angle pulse at a fixed crank angle period shorter than the period of the reference pulse. Fuel injection timing and ignition timing are electronically controlled by using the reference pulse and the crank angle pulse.

However, in the conventional control method, when the reference pulse is not generated because of a fault or abnormality in the reference pulse sensor, e.g., the breakage thereof, control of the fuel injection timing and the ignition timing is rendered impossible, and as a result it is hard to control the engine.

SUMMARY OF THE INVENTION

It is an object of the present invention to control an internal combustion engine by generating an auxiliary pulse, in addition to the crank angle pulse, from a second crank angle position detecting means upon generation of a reference pulse, and to use the auxiliary pulse when the reference pulse sensor is not operating properly.

To attain the above object, according to the present invention, the control of an internal combustion engine includes using a first crank angle position detecting means for generating a reference pulse at a predetermined crank angle period in synchronization with the rotation of a crank shaft of the internal combustion engine, and a second crank angle position detecting means for generating a crank angle pulse at a fixed crank angle period shorter than the period of the reference pulse. The operation of the internal combustion engine is controlled by using the reference pulse and the crank angle pulse, wherein the reference pulse is generated between the crank angle pulses. Further, an auxiliary pulse is generated from the second crank angle position detecting means upon generation of the reference pulse. The internal combustion engine is controlled by using the auxiliary pulse when the first crank angle position detecting means is not operating properly.

BRIEF DESCRIPTION OF THE DRAWINGS

FIGS. 1*a* and 1*b* show a preferred embodiment of the sensors for detecting a crank angle in the internal combustion engine.

FIGS. 2*a*–2*d* are a timing chart of signals generated from the sensors.

DETAILED DESCRIPTION OF THE PREFERRED EMBODIMENT

Figure 3:
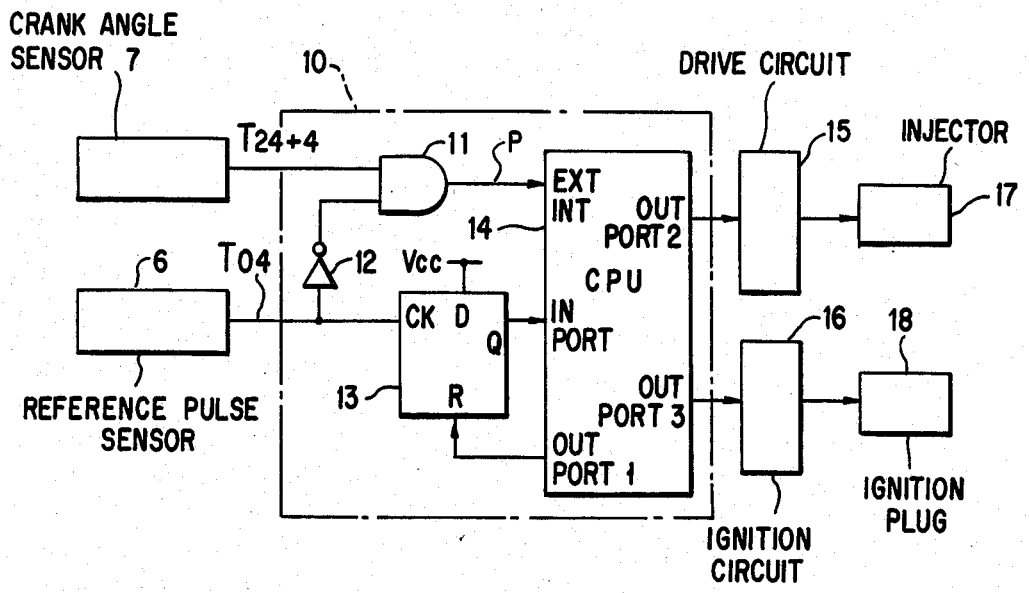
FIG. 3 is a block diagram showing a first embodiment of a control device for executing the control method of the present invention.

FIG. 1 shows a sensor for detecting the crank angle of a crank shaft of an internal combustion engine, in which two rotors 2 and 3 are fixed at predetermined intervals to a cam shaft 1. The sensors are rotated once per one engine cycle, that is, one per two rotations of the crank shaft. Four projections 2*a* are located at predetermined positions on an outer circumferential surface of the rotor 2, that is, at circumferentially equal intervals according to the number of cylinders of the internal combustion engine, e.g., 90 degrees of the camshaft 1 for four cylinders. The projections 2*a* extend outwardly in a radial direction. Twenty-four first projections 3*a* are located on an outer circumferential surface of the rotor 3 at fixed intervals smaller than the intervals of the projections 2*a*, e.g., at 30 degrees of the crank angle, namely, at a rotary angle of 15 degrees of the cam shaft 1. The first projections 3*a* extend outwardly in a radial direction. Each of the projections 2*a* of the rotor 2 is positioned between predetermined adjacent ones of the twenty-four projections 3*a*. Further, four second projections 3*b* are provided on the outer circumferential surface of the rotor 3 at positions corresponding to the projections 2*a* of the rotor 2, that is, between the predetermined adjacent projections 3*a*. The second projections 3*b* also extend outwardly in a radial direction. The interval between each of the second projections 3*b* and each of the predetermined adjacent projections 3*a* positioned forwardly with respect to a rotational direction of the cam shaft 1 is set to $\frac{1}{2}$ or less of the crank angle of the projections 3*a*. The rotors 2 and 3 are arranged so that the projections 2*a* and 3*a* may form a predetermined crank angle pulse.

The sensors, e.g., pickup coils 4 and 5, are provided at radially outward positions of the rotors 2 and 3 facing the projections 2*a* and 3*a* (3*b*) with a slight gap defined therebetween. A reference pulse sensor 6 is formed by the rotor 2, the projections 2*a* and the pickup coil 4, and a crank angle sensor 7 is formed by the rotor 3, the projections 3*a* and 3*b*, and the pickup coil 5. The pickup coils 4 and 5 generate a pulse signal every time they are opposed to the projections 2*a*, 3*a*, and 3*b* which rotate with rotation of the rotors 2 and 3.

The reference pulse sensor 6 generates a reference pulse $T_{04}$ at a predetermined crank angle position once every $\frac{1}{4}$ rotation of the cam shaft 1 for each cylinder (FIG. 2(*a*)). The crank angle sensor 7 generates a first crank angle pulse $T_{24}$ (which will be hereinafter referred to as a pulse Pa) at a predetermined crank angle position corresponding to each of the projections 3*a* every 15 degrees of rotation of the cam shaft 1, that is, every 30 degrees of rotation of the crank shaft (FIG. 2(*b*)), and generates a second crank angle pulse $T_{+4}$ (which will be hereinafter referred to as an auxiliary pulse Pb) at a crank angle position corresponding to each of the projections 3*b* (FIG. 2(*b*)). The pulse Pa inclusive of the auxiliary pulse Pb is represented by a crank angle pulse $T_{24+4}$. The auxiliary pulse Pb is generated at a predetermined angle of $\frac{1}{2}$ or less of the crank angle of 30 degrees from a preceding pulse Pa.

The reference pulse $T_{04}$ is generated at a position corresponding to each cylinder and where the crank angle pulse Pa is not generated, e.g., at a substantially central position between the adjacent pulses Pa (FIGS. 2(*a*) and 2(*b*)), and the auxiliary pulse Pb is generated at the same position as the reference pulse $T_{04}$. Accordingly, as shown in FIG. 2(*b*), distance between pulses of the crank angle pulse $T_{24+4}$ is less at the crank angle position where the auxiliary pulse Pb is generated.

FIG. 3 is a schematic diagram of an electronic control device of the present invention. The crank angle sensor 7 is connected to one input terminal of an AND circuit 11 in a control device 10. The reference pulse sensor 6 is connected through an inverter 12 to the other input terminal of the AND circuit 11, and is also connected to a clock input terminal CK of a flip-flop circuit 13. The output terminal of the AND circuit 11 and the output terminal Q of the flip-flop circuit 13 are connected at an external interruption terminal EXT INT and an input terminal IN PORT of a central processing unit (which will be hereinafter referred to as CPU) 14, respectively. The reset input terminal R of the flip-flop circuit 13 is connected to the output terminal OUT PORT 1 of the CPU 14.

A drive circuit 15 and an ignition circuit 16 are connected to the other output terminals OUT PORT 2 and OUT PORT 3 of CPU 14, respectively, and an injection valve 17 and a plug 18 (both being singly shown) of each cylinder are connected to the drive circuit 15 and the ignition circuit 16, respectively.

The AND circuit 11 is OFF during generation of the $T_{04}$ pulse (FIG. 2(*a*)), and even when the Pb pulse of the $T_{24+4}$ pulse (FIG. 2(*b*)) is generated synchronously with the $T_{04}$ pulse, the Pb pulse is not outputted from the AND circuit 11 (shown by a dotted line in FIG. 2(*d*)). The AND circuit 11 is ON when the $T_{04}$ pulse is not generated, and the Pa pulse of the $T_{24+4}$ pulse (FIG. 2(*b*)) is outputted from the AND circuit 11 (FIG. 2(*d*)). Thus, the Pa pulse is outputted from the AND circuit 11 between adjacent $T_{04}$ pulses.

When an expected $T_{04}$ pulse is not generated (shown by the dotted line in FIG. 2(*a*)), the Pb pulse is outputted from the AND circuit 11 (FIG. 2(*d*)). Accordingly, when the $T_{04}$ pulse is generated, there is no Pb pulse in the output of the AND gate 11, but when the $T_{04}$ pulse is not generated, the Pb pulse is outputted from the AND gate 11. The pulse P from the AND circuit 11 is shown in FIG. 2(*d*).

When the $T_{04}$ pulse is generated, the flip-flop circuit 13 is set, and an output Q therefrom becomes high as shown in FIG. 2(*c*).

The high level output is detected by the CPU 14 when the Pa pulse is fed from the AND circuit 11 to the CPU 14 just after the disappearance of the $T_{04}$ pulse, and it is determined that the present input Pa pulse is generated at the reference crank angle position. The flip-flop circuit 13 is reset by a reset signal subsequently supplied from the CPU 14, and the output Q becomes low.

The CPU 14 performs fuel injection timing control and ignition timing control (normal control) in a normal state (where the $T_{04}$ pulse is generated) using the output Q from the flip-flop circuit 13 (which will be hereinafter referred to simply as an output Q) and the pulse P from the AND circuit 11. However, in an abnormal state, where the $T_{04}$ pulse is not generated because of the breakage of the reference pulse sensor 6 for example, the output Q from the flip-flop circuit 13 is retained in the low level state, and the output pulse P from the AND circuit 11 has a waveform equal to that of the $T_{24+4}$ pulse (FIGS. 2(*b*) and 2(*d*)). As a result, the rapid change in the distance between the P pulses is detected, and the output pulse P is determined to be identical with the Pb pulse which will be described in detail.

The CPU 14 computes that fuel injection time and the ignition advanced angle value according to engine parameter signals fed from an engine rotation sensor and an intake manifold absolute pressure sensor (both not shown), etc. on the basis of various operation programs stored in a memory (not shown), and generates a fuel injection timing control signal and an ignition timing control signal in synchronism with the Pa pulse in relation to the reference crank angle position. In normal control as mentioned above, the CPU 14 generates each of the control signals according to each of the engine parameters at each predetermined Pa pulse position (stage) after generation of the $T_{04}$ pulse to thereby control the engine in an optimum operational condition. Further, in an abnormal state where the $T_{04}$ pulse is not generated, the CPU 14 generates each of the control signals at each specific Pa pulse position after generation of the Pb pulse used as the $T_{04}$ pulse, that is, at a specific crank angle position to thereby control the engine. Thus, a vehicle may be maintained at least in a running condition even if there is a fault or abnormal condition in the generation of the $T_{04}$ pulse.

The drive circuit 15 controls the opening of the injection valve 17 according to the fuel injection timing control signal. The ignition circuit 16 acts to ignite the plug 18 according to the ignition timing control signal.

Figure 4:
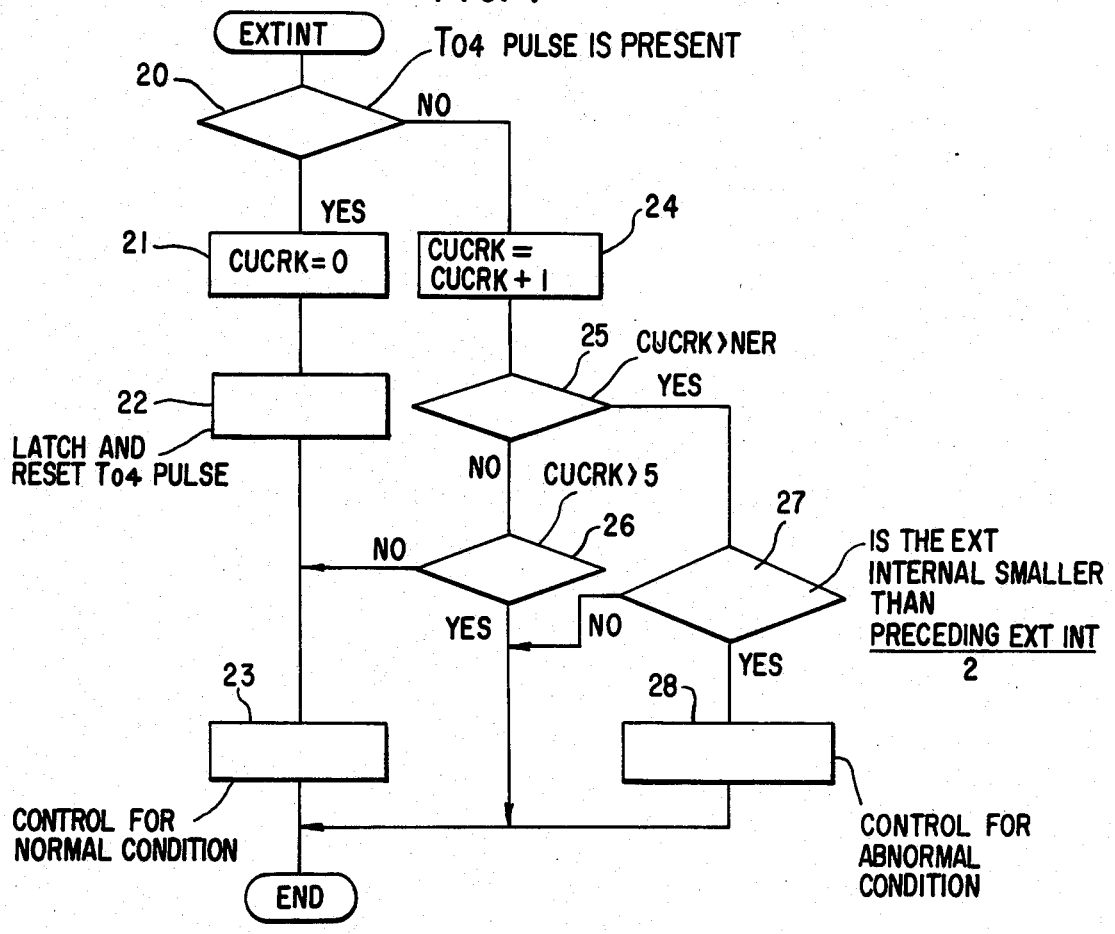
FIG. 4 is a flow chart showing a preferred embodiment of the method of controlling the internal combustion engine according to the present invention.

The control technique of the present invention will be described with reference to the flow chart in FIG. 4. First, when an interrupt signal is applied to the CPU 14 by the P pulse generated by the AND circuit 11, the CPU 14 performs interruption processing and determines whether or not the $T_{04}$ pulse (the output Q from the flip-flop circuit 13) was present, that is, whether or not the output Q is high level (step 20). If Yes at step 20, a value of the counter CUCRK for counting the $T_{24+4}$ pulse is set to zero (step 21) (FIG. 2(*b*)), and latch of the $T_{04}$ pulse is reset (step 22), that is, the flip-flop circuit 13 is reset. Then, the normal control, as discussed above, is performed to end the present program.

If there is a No at step 20, the value of the counter CUCRK is counted up by 1 (step 24), and it is determined whether or not the value of the counter CUCRK is greater than an abnormality determination number NER (e.g., 12) (step 25). If No at step 25, it is determined whether or not the value of the counter CUCRK is greater than the predetermined value 5 (step 26). The value 5 is set according to the generation six Pa pulses which are generated between the generation of normal $T_{04}$ pulses.

If No at step 26, that is, the value of the counter CUCRK becomes 5 or less, it is determined that a normal control is to be conducted, and the routine proceeds to step 23. If Yes at step 26, the present program is ended. In other words, when the value of the counter CUCRK exceeds the predetermined value 5 without generation of the $T_{04}$ pulse because of an abnormality, the processing for the control is not executed until the value exceeds the abnormality determination number NER, and thus malfunction due to noise or the like is prevented. Accordingly, the above-mentioned abnormality determination number NER is set large enough to prevent malfunction due to noise or the like, which is a value (e.g., 12) where the engine rotational speed is not rapidly decreased even when ignition is not executed.

If step 25 produces a Yes, that is, the value of the counter CUCRK exceeds the abnormality determination number NER, it is determined that the $T_{04}$ sensor system is abnormal, and the routine proceeds to step 27 where the input of the Pb pulse is awaited. Namely, at step 27, it is determined whether or not the period of the $T_{24+4}$ pulse is about the half of that in the previous stage, that is, whether or not the distance between the $T_{24+4}$ pulses has rapidly changed. If No at step 27, no processing for the control is executed and the present program is ended. Until the Pb pulse is generated instead of the $T_{04}$ pulse, the step 27 is repeatedly executed. On the other hand, if Yes at step 27, it is determined that the present input pulse P corresponds to the Pb pulse, and the routine proceeds to step 28. At step 28, the Pb pulse is used as the $T_{04}$ pulse, and the above-mentioned abnormality control is conducted.

Thus, when the $T_{04}$ pulse is normal, the auxiliary pulse Pb of the $T_{24+4}$ pulse is eliminated by the $T_{04}$ pulse, and the above-mentioned normal control is conducted by using the $T_{04}$ pulse and the Pa pulse of the $T_{24+4}$ pulse. When the $T_{04}$ pulse is abnormal, that is, the $T_{04}$ pulse is not generated because of a fault in the reference pulse sensor 6 for example, the above-mentioned auxiliary pulse Pb is not eliminated, and the auxiliary pulse Pb is used as the $T_{04}$ pulse, that is, the control is performed using the $T_{24+4}$ pulse. The abnormality control is not limited to a fixed stage ignition, but rather uses the Pb pulse as a substitute for the $T_{04}$ pulse.

In the embodiment of FIG. 3, it is difficult to hide Pb because of the timing between $T_{04}$ and Pb. The embodiment of FIG. 5 differs from the embodiment of FIG. 3 in that in addition to providing an alternative reference pulse when there is a failure of reference pulse, the failure can be easily detected.

Figure 5:
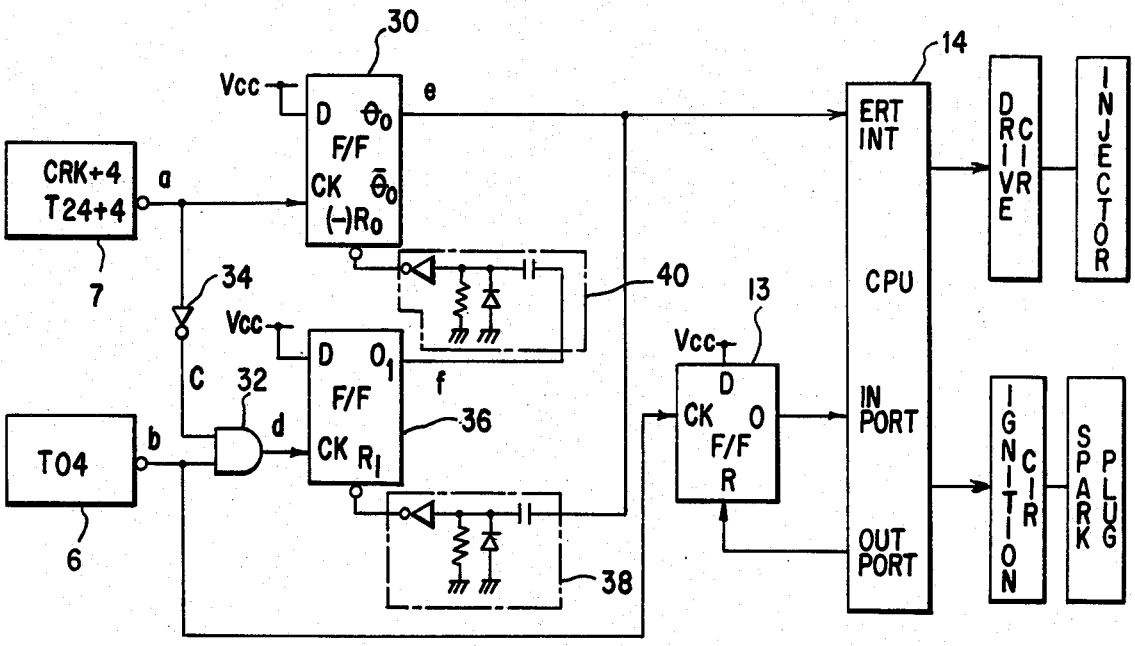
FIG. 5 is an alternative embodiment of a control device for executing the control method of the present invention.

Referring to FIG. 5, crank angle sensor 7 is connected to the clock input of flip-flop 30, thus the $T_{24+4}$ crank angle signal (a) is applied to the clock input of flip-flop 30. The $T_{24+4}$ crank angle signal (a) is also applied to one input of AND gate 32 through the inverter 34 as signal (c). The other input of AND gate 32 is connected to the output of reference pulse sensor 6 and receives the $T_{04}$ signal (b). Thus AND gate 32 has an inverted $T_{24+4}$ signal (c) and a $T_{04}$ signal (b) applied thereto. The output of AND gate 32 (d) is applied to the clock input of flip-flop 36. The output $Q_0$ of flip-flop 30 is applied to the EXT INT (EXTernal INTerrupt) port of CPU 14. The $Q_0$ output of flip-flop 30 (e) is also applied to a differentiator circuit 38 which has an output applied to the reset input of flip-flop 36. The output $Q_1$ of flip-flop 36 (f) is applied through a second differentiator circuit 40 to the reset input of flip-flop 30.

Figure 6:
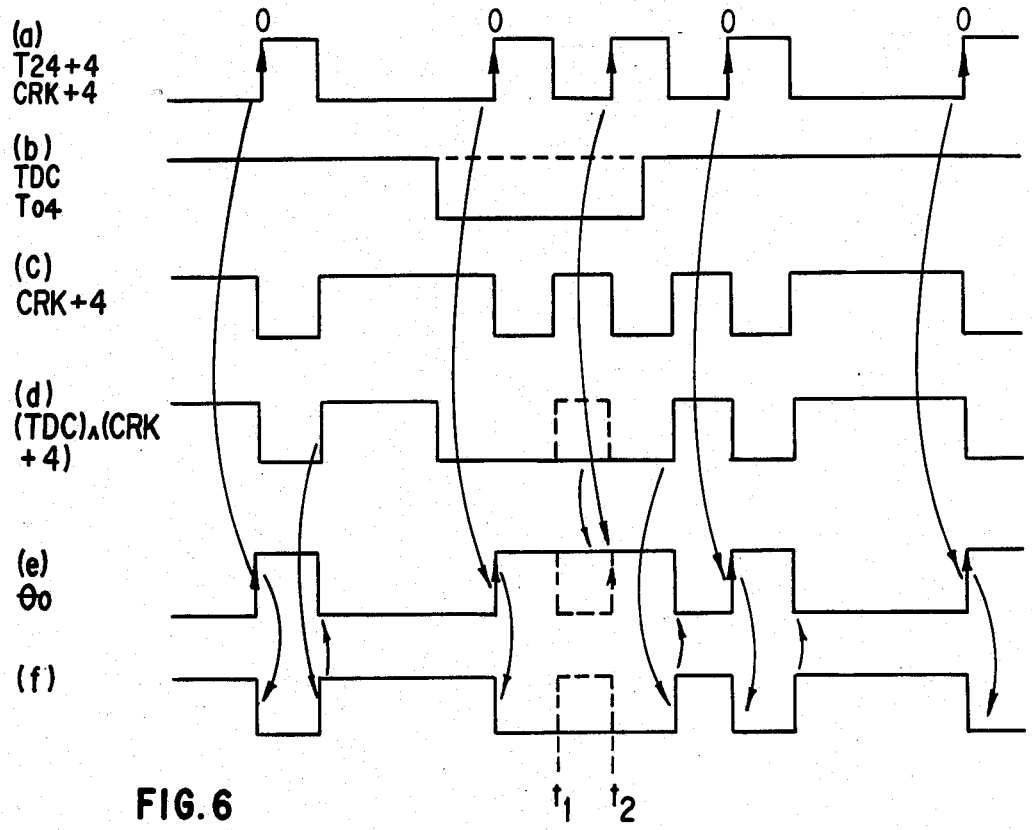
FIG. 6 illustrates the signals at various points in the circuit of FIG. 5.

Referring to FIG. 6, during normal operation, the $T_{24}$ pulse of signal (a) drops from high to low. The low signal is inverted by inverter 34 and is applied to one input of AND gate 32 as signal (c). The other input to AND gate 32 is the $T_{04}$ pulse signal (b) which is low. Since the output (d) of AND gate 32 having one low input signal is low, flip-flop 36 is not set so that the output thereof, signal (f), remains low. As this signal does not change the state, the reset pulse which reset the flip-flop 30 does not generate. The $T_{24}$ pulse signal (a) is applied to the clock input of flip-flop 30 which causes the output signal (e) thereof to be high.

Thus it can be seen that since the $T_{04}$ pulse signal (b) is low, the falling edge of the $T_{24}$ pulse does not have any effect for the occurence of the auxiliary pulse.

Alternatively, during abnormal operation of the $T_{04}$ signal, as shown by the dotted line in signal (b), when the $T_{24}$ pulse switches to low, the output of inverter 34 switches to high and signal (c), which is high, is applied to one input of AND gate 32. Since the $T_{04}$ pulse is abnormal, as indicated by the dotted line, the other input to AND gate 32 is also high and signal (d) switches to high. This causes flip-flop 36 to be set and output (f) thereof switches to high, as indicated by the dotted line. Signal (f) is differentiated and inverted which causes flip-flop 30 to reset resulting in signal (e) switching to low. Then at time T1 the rise of the Pb pulse of signal (a) causes signal (c) to switch to a low level which results in the output of signal (d) of AND gate 32 switching to a low level. The rising edge of the Pb pulse is applied to the set input of flip-flop 30 which causes signal (e) to rise. This rise in signal (e) is applied to the reset input of flip-flop 36 through differentiator 38 which causes the output signal (f) to switch to low. This falling edge is differentiated but diode in the differentiator 38 prevent the occurence of negative pulse, it does not reset flip-flop 30.

In the abnormal operation, there is a switching of signal (e) at time $t_1$ and at time $t_2$. This switching can be detected in order to provide an indication of the abnormal operation of the $T_{04}$ signal.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

We claim:

1. In a method of controlling an internal combustion engine for generating a reference pulse at a predetermined crank angle period in synchronization with the rotation of a crank shaft of said internal combustion engine, and generating crank angle pulses at a fixed crank angle period shorter than the period of the reference pulses, wherein the operation of said internal combustion engine is controlled by using the reference pulse and the crank angle pulse, the improvement comprising generating the reference pulse between the crank angle pulses, and generating an auxiliary crank angle pulse in synchronism with the normal generation of the reference pulse, wherein said internal combustion engine is controlled using the auxiliary pulse when the generation of the reference pulse is abnormal.

2. The method of controlling an internal combustion engine as defined in claim 1, wherein an output corresponding to the auxiliary pulse is prevented by the generation of a normal reference pulse and wherein the crank angle pulse has a fixed crank angle period.

3. The control method of controlling an internal combustion engine as defined in claim 2, wherein a crank angle between the auxiliary pulse and the crank angle pulse to be generated just prior to the auxiliary pulse is $\frac{1}{2}$ or less of the fixed crank angle.

4. The method of controlling an internal combustion engine as set forth in claim 1, wherein the control of the internal combustion engine by the auxiliary pulse is delayed until a predetermined number of reference pulses have not be generated.

5. An apparatus for controlling an internal combustion engine comprising first crank angle position detecting means for generating reference pulses at predetermined crank angle periods in synchronization with the rotation of the crank shaft of the internal combustion engine, second crank angle position detecting means for generating crank angle pulses at a fixed crank angle and auxiliary crank angle pulses corresponding to the reference pulse, said crank angle pulses having a period less than the period of said reference pulses, and control means for determining when the output of said first crank angle position detecting means is abnormal and for using the auxiliary crank angle pulses in place of the reference pulses for controlling the engine.

6. The apparatus as set forth in claim 5, including means for delaying the use of auxiliary crank angle pulses in place of the reference pulses until a predetermined number of reference pulses are determined to be abnormal.

7. An apparatus as set forth in claim 5, wherein said second crank angle position detecting means includes a rotor having first projections positioned at equal angles on said rotor and second projections positioned at positions corresponding to the generation of the reference pulses by said first crank angle position detecting means.

8. An apparatus as set forth in claim 5, wherein said control means comprises an inverter means having an input connected to the output of said first crank angle position detecting means; an AND gate having one input connected to the output of said inverter means and another input connected to the output of said second crank angle detecting means, flip-flop means having the set input thereof connected to said first crank angle detecting means, and CPU means having input terminals thereof connected to the outputs of said AND gate and said flip-flop means, and wherein one output of said CPU means is connected to the reset input of said flip-flop means.

9. An apparatus as set forth in claim 5, wherein said control means comprises first and second flip-flop means, the clock input of said first flip-flop means being connected to said second crank angle detecting means; an inverter means having the input thereof connected to the output of said second crank angle detecting means; an AND gate having one input connected to the output of said inverter means and another input connected to the output of said first crank angle detecting means, the output of said AND gate being connected to the clock input of said second flip-flop means; a first differentiator means having the input thereof connected to the output of said second flip-flop means and the output thereof connected to the reset input of said first flip-flop means; a second differentiator means having the input thereof connected to the output of said first flip-flop means and the output thereof connected to the reset input of said first flip-flop means; CPU means having one input thereof connected to the output of said first flip-flop means; and a third flip-flop means, said third flip-flop means having the set input thereof connected to the output of said first crank angle detecting means, the reset input thereof connected to an output of said CPU means, and the output thereof connected to an input of said CPU means.

* * * * *

UNITED STATES PATENT AND TRADEMARK OFFICE

CERTIFICATE OF CORRECTION

PATENT NO. : 4,644,917

DATED : February 24, 1987

INVENTOR(S) : MASAHIKO YAKUWA ET AL

It is certified that error appears in the above-identified patent and that said Letters Patent is hereby corrected as shown below:

Please correct Figures 2B, 4, 5 and 6 as shown in the attached sheets of drawings.

The title page showing the illustrative figure should be deleted to appear as per attached title page.

Signed and Sealed this

Eighteenth Day of August, 1987

*Attest:*

*Attesting Officer*

DONALD J. QUIGG

*Commissioner of Patents and Trademarks*

United States Patent [19]

Yakuwa et al.

[11] Patent Number: 4,644,917

[45] Date of Patent: Feb. 24, 1987

[54] METHOD AND APPARATUS FOR CONTROLLING AN INTERNAL COMBUSTION ENGINE

[75] Inventors: Masahiko Yakuwa; Hideto Iijima, both of Wako, Japan

[73] Assignee: Honda Giken Kogyo Kabushiki Kaisha, Tokyo, Japan

[21] Appl. No.: 826,536

[22] Filed: Feb. 6, 1986

[30] Foreign Application Priority Data

Feb. 6, 1985 [JP] Japan ..... 60-19856

[51] Int. Cl.[4] ..... F02P 5/00

[52] U.S. Cl. ..... 123/414; 123/416; 123/417

[58] Field of Search ..... 123/414, 416, 418, 424, 123/406

[56] References Cited

U.S. PATENT DOCUMENTS

| | | | |
|---|---|---|---|
| 3,738,339 | 6/1973 | Huntzinger et al. | 123/416 |
| 3,923,021 | 12/1975 | Stark | 123/416 |
| 4,061,938 | 12/1977 | Hashimoto et al. | 123/414 |
| 4,181,884 | 1/1980 | Shirasaki et al. | 123/416 |
| 4,250,846 | 2/1981 | Manard | 123/414 |
| 4,324,217 | 4/1982 | Ina et al. | 123/416 |
| 4,355,613 | 10/1982 | Rode et al. | 123/417 |
| 4,378,004 | 3/1983 | Petrie | 123/416 |
| 4,380,983 | 4/1983 | Kobashi et al. | 123/416 |
| 4,485,784 | 12/1984 | Fuji et al. | 123/416 |

*Primary Examiner*—Raymond A. Nelli

*Attorney, Agent, or Firm*—Armstrong, Nikaido, Marmelstein & Kubovcik

[57] ABSTRACT

A method and apparatus for controlling an internal combustion engine is provided, the apparatus includes using a first crank angle position detector for generating a reference pulse at a predetermined crank angle period in synchronization with the rotation of a crank shaft of the internal combustion engine, and a second crank angle position detector for generating a crank angle pulse at a fixed crank angle period shorter than the period of the reference pulse. The operation of the internal combustion engine is controlled by using the reference pulse and the crank angle pulse, wherein the reference pulse is generated between the crank angle pulses. Further, an auxiliary pulse is generated from the second crank angle position detector upon generation of the reference pulse. The internal combustion engine is controlled by using the auxiliary pulse when the first crank angle position detector is not operating properly.

9 Claims, 10 Drawing Figures

FIG.2B

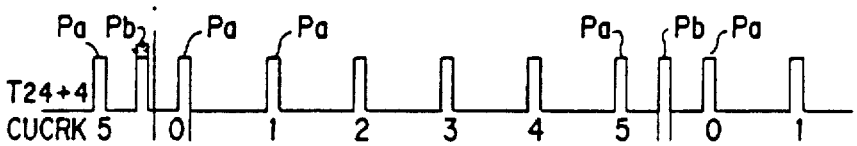

UNITED STATES PATENT AND TRADEMARK OFFICE

CERTIFICATE OF CORRECTION

PATENT NO. : 4,644,917

DATED : February 24, 1987

INVENTOR(S) : MASAHIKO YAKUWA ET AL.

It is certified that error appears in the above-identified patent and that said Letters Patent is hereby corrected as shown below:

FIG.2B

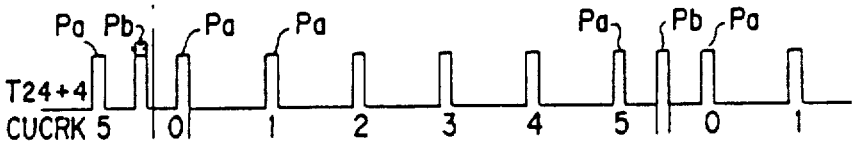

FIG. 4

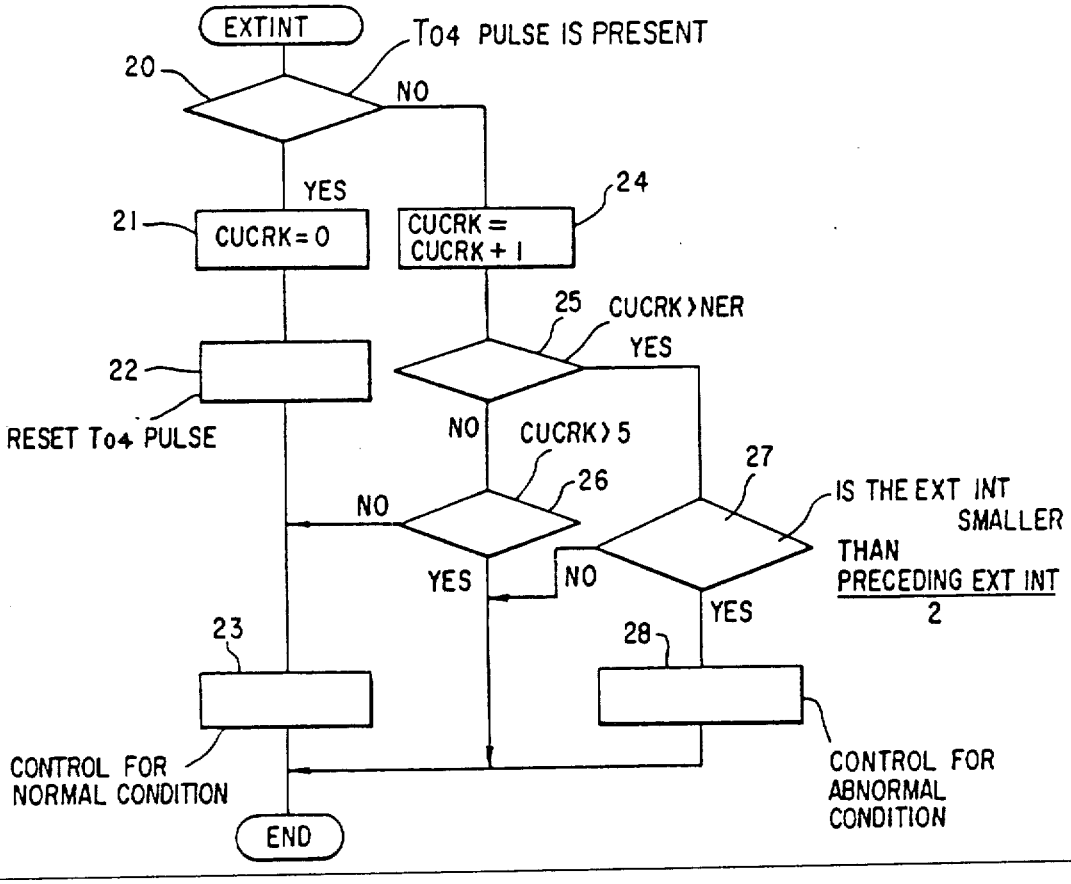

UNITED STATES PATENT AND TRADEMARK OFFICE

CERTIFICATE OF CORRECTION

PATENT NO. : 4,644,917

DATED : February 24, 1987

INVENTOR(S) : MASAHIKO YAKUWA ET AL.

It is certified that error appears in the above-identified patent and that said Letters Patent is hereby corrected as shown below:

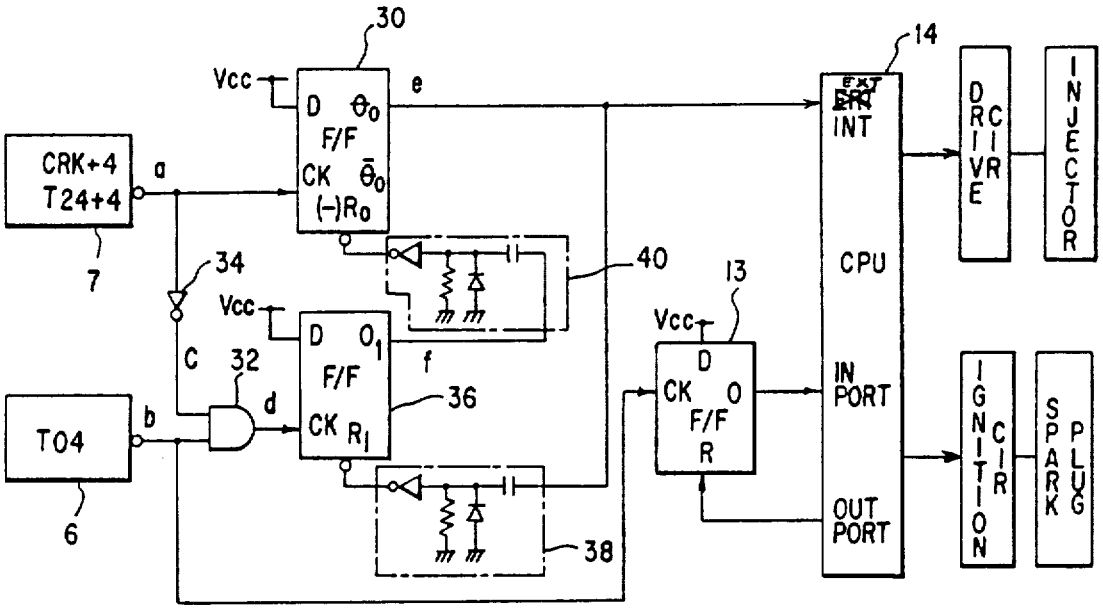

FIG.5

UNITED STATES PATENT AND TRADEMARK OFFICE

CERTIFICATE OF CORRECTION

PATENT NO. : 4,644,917

DATED : February 24, 1987

INVENTOR(S) : MASAHIKO YAKUWA ET AL.

It is certified that error appears in the above-identified patent and that said Letters Patent is hereby corrected as shown below:

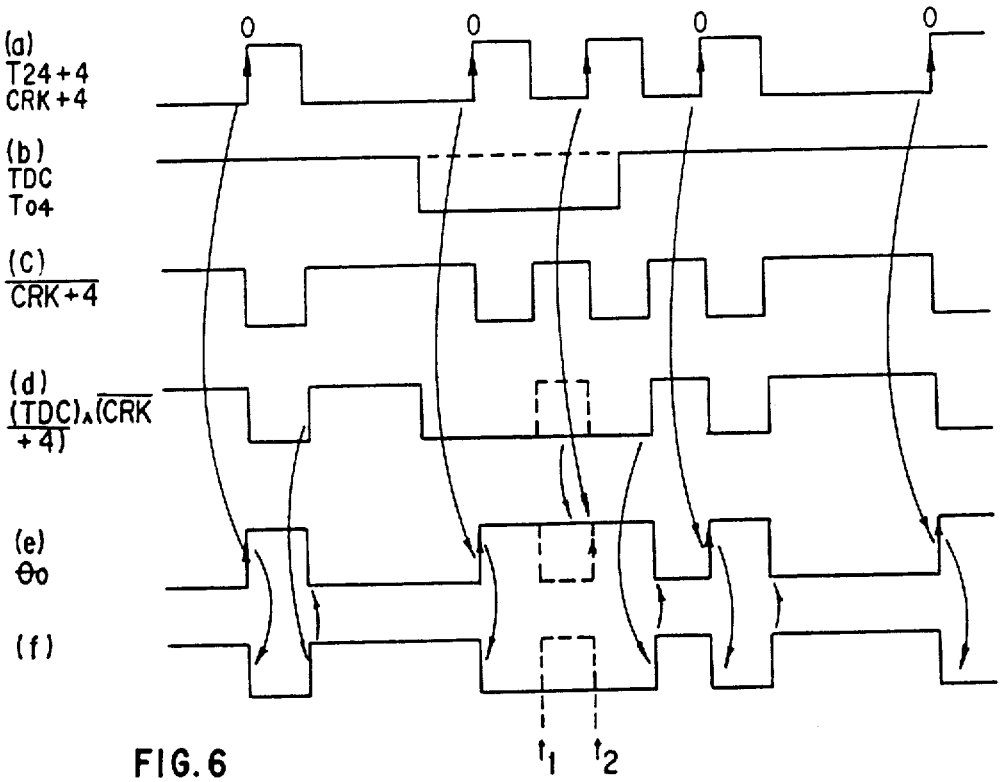

FIG. 6